United States Patent [19]

Shichida

[11] Patent Number: 4,725,239

[45] Date of Patent: Feb. 16, 1988

[54] ELECTRICAL CONNECTION JACK

[75] Inventor: Akihito Shichida, Higashiosaka, Japan

[73] Assignee: Hoshiden Electronics Co., Ltd., Yao, Japan

[21] Appl. No.: 62,404

[22] Filed: Jun. 15, 1987

Related U.S. Application Data

[63] Continuation of Ser. No. 874,834, Jun. 16, 1986, abandoned, which is a continuation of Ser. No. 645,726, Aug. 30, 1984, abandoned.

[30] Foreign Application Priority Data

| | | | |
|---|---|---|---|
| Aug. 31, 1983 | [JP] | Japan | 58-135904[U] |
| Nov. 15, 1983 | [JP] | Japan | 58-176966[U] |
| Nov. 30, 1983 | [JP] | Japan | 58-186047[U] |

[51] Int. Cl.[4] ..... H01R 39/00; H01R 17/18

[52] U.S. Cl. ..... 439/29; 439/668; 439/887

[58] Field of Search ..... 439/11-30, 439/668, 669, 886, 887

[56] References Cited

U.S. PATENT DOCUMENTS

| | | | |
|---|---|---|---|
| 2,137,258 | 11/1938 | Berger et al. | 339/183 |
| 2,228,683 | 1/1941 | Barrelle | 339/182 RS |
| 2,625,577 | 1/1953 | Wier | 339/183 |
| 2,717,367 | 9/1955 | Pueruer | 439/668 |
| 2,731,614 | 1/1956 | Geib et al. | 339/183 |
| 3,005,173 | 10/1961 | Aske | 339/182 RS |
| 3,145,329 | 8/1964 | Deakin et al. | 339/183 |
| 3,289,149 | 11/1966 | Pawloski | 339/183 |
| 3,418,438 | 12/1968 | Barrett | 339/183 |
| 3,435,163 | 3/1969 | Bailey et al. | 339/183 |
| 4,040,696 | 8/1977 | Wada et al. | 339/182 RS |

FOREIGN PATENT DOCUMENTS

| | | | |
|---|---|---|---|
| 1030913 | 5/1966 | United Kingdom | 339/182 RS |
| 2111770 | 7/1983 | United Kingdom | 439/668 |
| 449408 | 6/1975 | U.S.S.R. | 339/278 C |

OTHER PUBLICATIONS

"Palladium with a Thin Gold Layer as a Sliding Contact Material", IEEE Transactions, vol. CHMT-4, No. 1, Mar. 1981, by Sato et al.

Marks' Standard Handbook of Mechanical Engineering, Eighth Edition, by Baumeister, Avallore and Baumeister, pp. 8-130, published by McGraw-Hill.

*Primary Examiner*—Gil Weidenfeld
*Assistant Examiner*—Gary F. Paumen
*Attorney, Agent, or Firm*—Armstrong, Nikaido, Marmelstein & Kubovcik

[57] ABSTRACT

An electrical connection jack, into which a rotary plug is plugged in, uses oil impregnate metal in at least a sleeve brought into contact with a trunk of the plug.

6 Claims, 5 Drawing Figures

ELECTRICAL CONNECTION JACK

This application is a continuation of application Ser. No. 874,834 filed 6/16/86 now abandoned, which is a continuation of application Ser. No. 645,726 filed 8/30/84 now abandoned.

FIELD OF THE INVENTION

This invention relates to an electrical connection jack, and more particularly to an electrical connection jack into which a rotary plug is to be inserted.

BACKGROUND OF THE INVENTION

A turn-table system electronic cooking range, for example, inserts a rod-like thermocouple into cooked beef to measure an internal temperature thereof to thereby automatically control a roasting condition of beef.

In such case, since the thermocouple rotates together with beef, it is problematical to connect a plug mounted to one end of thermocouple with a jack into which the plug is to be inserted.

Such connecting means includes, for example, the jack supported rotatably to the ceiling of a cooking room, in which at the upper end of jack is mounted two round electrodes conductive with internal segments, and ship-like contact segments of elasticity is mounted to the frame supporting the jack.

The plug is inserted into the jack to fetch a detection signal of thermocouple through the round electrode and contact segments in contact therewith.

Such conventional method rotates the jack in itself and disposes the strip-like contact segments perpendicularly to the rotary axis, thereby having created the problem in that a plug support portion inclusive of the jack is complicated in construction and becomes larger in the size. Also, since sliding caused by rotation of electrode and contact segments increases, an improvement in wear resistance at the rotary contact portion has been required.

SUMMARY OF THE INVENTION

An object of the invention is to provide an electrical connection jack into which a rotary plug is to be inserted and which has a plug support portion simple in construction and small-sized.

Another object of the invention is to provide an electrical connection jack improvable of the wear resistance of the portion in contact with the rotary plug.

This invention can support the rotary plug without rotating the jack itself, whereby the plug supporting portion is made simpler in construction and larger in the size than the conventional one of rotating the jack itself. Also, the use of oil impregnate metal in the contact portion with the rotating plug is improvable of wear resistance.

In brief, the present invention is characterized in that the electrical connection plug into which the rotary plug is inserted uses oil impregnate metal to at least a sleeve in contact with the trunk of the plug.

These and other objects of the invention will become more apparent in the detailed description and examples which follows.

DESCRIPTION OF THE PREFERRED EMBODIMENT

Figure 1:
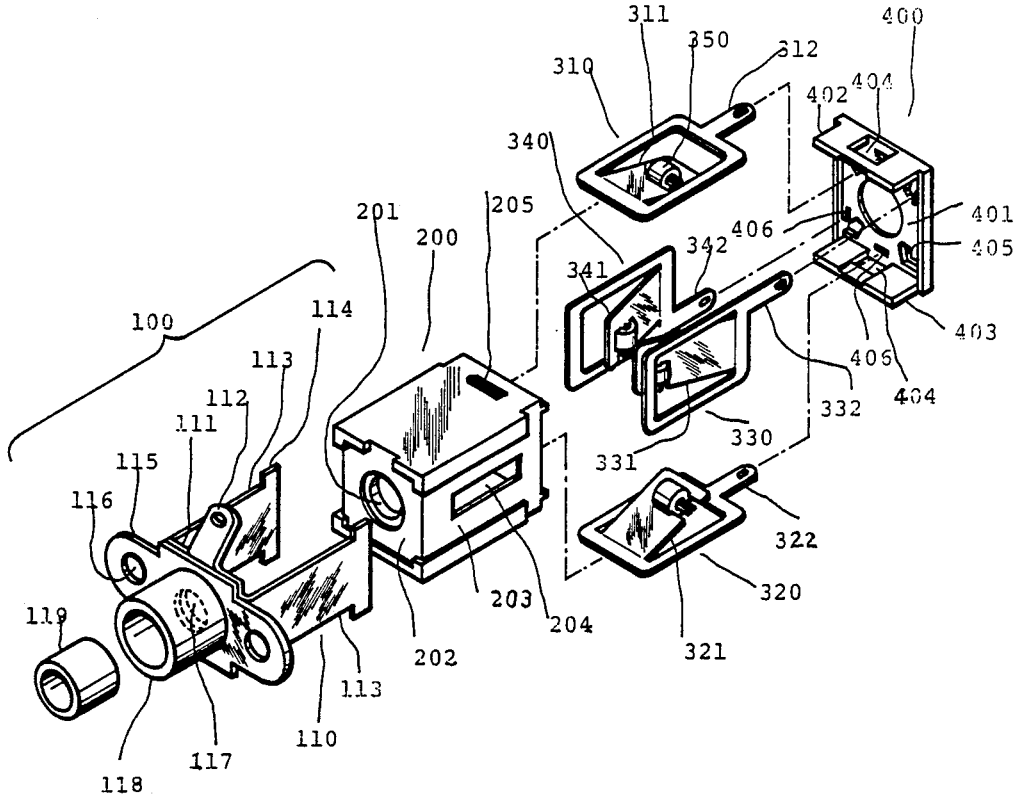
FIG. 1 is a perspective exploded view of an embodiment of an electrical connection jack of the invention.

An electrical connection plug shown in FIG. 1 includes a sleeve unit 100, a casing 200, contact segments 310 to 340 and a holder 400.

In the sleeve unit 100, reference numeral 110 designates a support plate bent in U-like shape. A tongue-like terminal 112 is provided at a front plate 111 at the holder 110, retainer segments 114 vertically projecting are formed at the utmost end corners of side plates 113 at the holder 110, and a fixing plate 115 provided at both sides with threaded through bores 116 are mounted to the front plate 111, the front plate 111 and fixing plate 115 providing plug insertion bores 117 respectively. A cylinder 118 is mounted concentrically with the insertion bores 117 and a sleeve 119 of oil impregnate metal is press-fitted into the cylinder 118.

Figure 2:
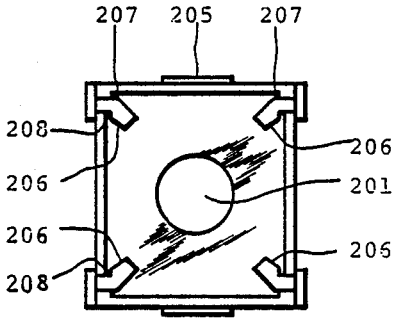
FIG. 2 is an illustration of a casing in FIG. 1 when viewed from a side of an opening insertable of contact segments.

The casing 200 is a bottomed box-like-shaped member open at the segment insertion side and molded integrally with insulating synthetic resin. A plug insertion bore 201 is bored at the wall of casing 200 abutting against the front plate 111 at the support plate 110, the abutting surface providing a shallow recess 202 to be fitted onto the front plate 111. Also, at both lateral side surfaces of casing 200 are provided shallow grooves to be fitted to the side plates 113 at the support plate 110 and extending lengthwise of casing 200, and bored elongate slots 204 for allowing an escape of the metal chip at the contact segment to be discussed below. On the upper and lower surfaces of casing 200 at the opening side are formed retaining projections 205 each having a slope downward toward the opening. Next, explanation will be given on the casing 200 in FIG. 2 when viewed from the contact segment insertion opening side. The opening at the contact segment insertion side has at four corners thereof hooked projecting ribs 206 each projecting at one end from each corner, the projecting ribs 206 extending at the other ends toward the inside of front plate 111. Between the projecting ribs 206 and the inner surfaces of four side plates at the casing 200, guide grooves 207 and 208, into which contact segments 310, 320, 330 and 340 are to be inserted, are formed respectively.

Referring again to FIG. 1, the contact segments 310, 320, 330 and 340 are formed by punching an elastic metal plate of, for example, phosphor bronze. Movable tongues 311, 321, 331 and 341 are formed of rectangular metal plates cut at the inner portion is U-like shape and raised respectively, especially the movable tongues 311 and 321 at the contact segments 310 and 320 are each cut and raised at the root near the front plate 202 of the casing 200. The respective contact segments 310 to 340 are provided at the edges at the opening sides with terminals 312, 322, 332 and 342 respectively, the movable tongues 311, 321, 331 and 341 being attached with oil impregnate metal chips 350 cylindrical and smaller in axial length respectively.

Figure 3:
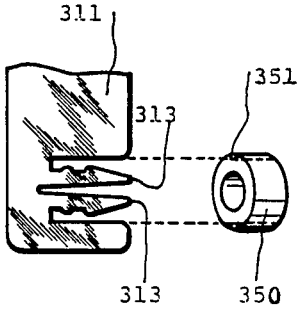
FIG. 3 is an illustration of a mounting method of an oil impregnate metal chips to the contact segments.

Next, explanation will be given on construction for mounting the oil impregnate metal chip in accordance with FIG. 3. For example, in the movable tongue 311, the fore end portion thereof is cut widthwise in furcation as shown. The oil impregnate metal chip 350 is provided at the outer periphery with smaller grooves 351 extending axially of chip 350 and opposite to each other, so that the furcate retaining projections 313 are elastically transformed to be fitted into an inner bore at the chip 350 and the cut edges opposite to the projections 313 are fitted into the small grooves 351 at the chip 350 respectively, thus mounting the oil impregnate metal chip 350 to the movable tongue 351 and holding it stably with respect to plug in or out and to rotation of the plug.

The holder 400, as shown in FIG. 1, is nearly U-like-shaped to sandwich both the upper and lower walls of casing 200 to thereby prevent each inserted contact segment from escaping from the casing 200, and molded integrally with insulating resin. A vertical plate 401 at the holder 400 is provided at both upper and lower ends with clipping brackets 402 and 403 having at the central portions engaging bores 404 engageable with the retaining projections 205 at the casing 200 respectively. The vertical plate 401 is provided at the central portion with a bore about equal in diameter to the plug, at the four corners with bores 405 into which the ends of projecting ribs 206 are fitted respectively, and at two diagonally opposite corners and the intermediate portions at two opposite sides with guide bores 406 corresponding to the terminals 312, 322, 332 and 342 at the contact segments 310 to 340 respectively.

The aforesaid components are assembled as follows:

The contact segments 310 and 320 are inserted into the casing 200 and in contact with the inner upper and lower surfaces thereof and those 330 and 340 into the casing 200 and in contact with the inner lateral side surfaces respectively. The holder 400 is fitted onto the opening at the casing 200 to project the terminals at the contact segments 310 to 340 outwardly from the holder 400 through guide bores 406 respectively and the retaining projections 205 at the casing 200 are fitted into the engaging bores 404 respectively, thereby retaining the holder 400 to the casing 200. Then, the sleeve unit 100 is mounted in the front of casing 200 to about against the front surface thereof, at which time retaining portions 114 at the sleeve unit 100 engage with the ends of grooves respectively, thereby retaining the sleeve unit 100 to the casing 200.

Figure 4:
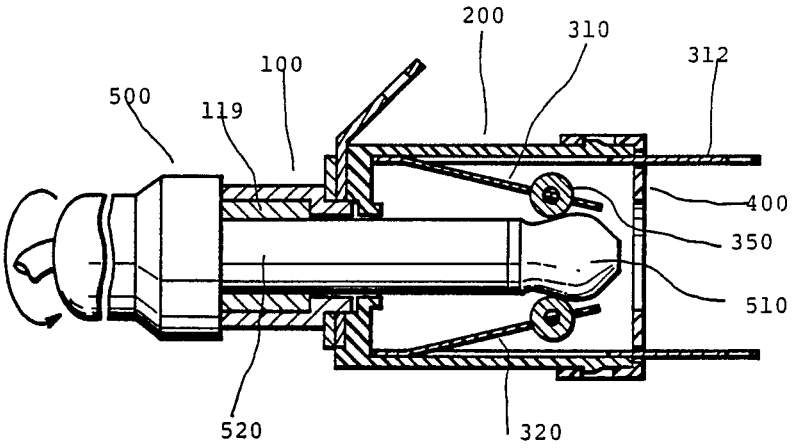
FIG. 4 is a sectional view of the embodiment of the electrical connection plug when a rotary plug is inserted therein.
Figure 5:
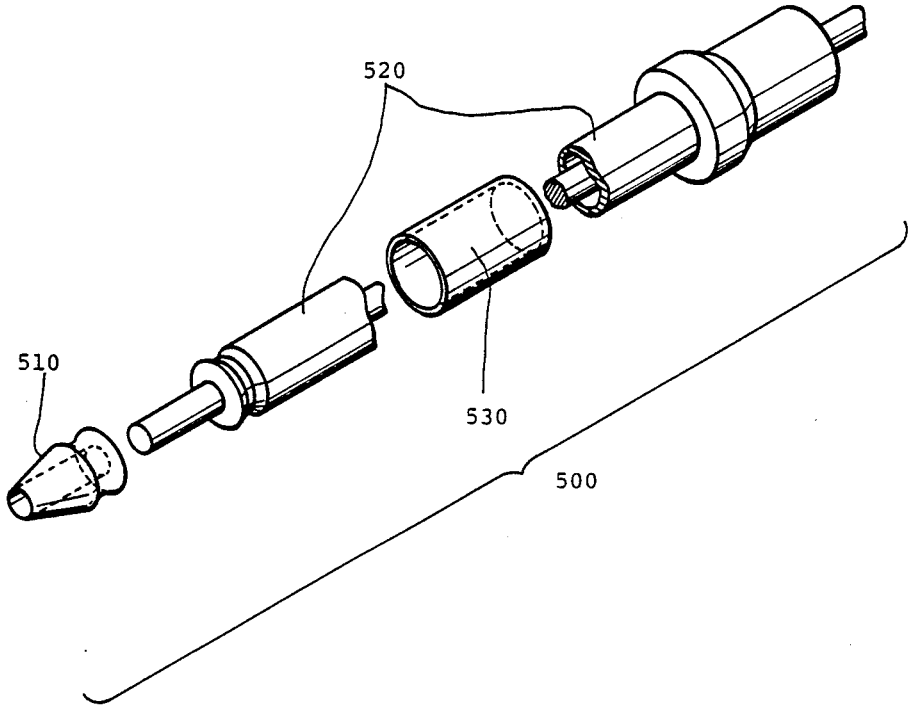
FIG. 5 is a perspective exploded view of the plug using oil impregnate metal at the rotary contact portion.

Next, explanation will be given on the state where the rotary plug is plugged into the electrical connection jack of the invention of reference to FIG. 4, in which the components identical with those in FIG. 1 are designated by the same reference numerals.

The rotating plug 500 comes into contact at it chip 510 with the oil impregnate metal chips 350 at the contact segments 310 and 320, the trunk 520 of plug 500 being supported in contact with a sleeve 119 and contacting with the oil impregnate metal chips 350 at the contact segments 330 and 340 (where the chips 350 are not shown). In this case, the terminals 112, 332 and 342 are short-circuited to be used as the ground terminals to ensure grounding of plug, the terminals 312 and 320 being short-circuited when in use.

Since the plug 500 inserted is subjected to an about equal urging force in every direction by the contact segments 310, 320, 330 and 340, the trunk 520 is prevented from being subjected to a deflection, thereby smoothing the rotation of plug.

The terminals 332 and 342 in the aforesaid embodiment, which are used together with the terminal 112 as the ground terminal, are not indispensably grounded, so that the terminal 112 only may be used as the ground terminal.

Also, the wear preventing means in the aforesaid embodiment is not limited to the use of oil impregnate metal in the contact portion of jack. For example, the oil impregnate metal may alternatively be used in the contact portion of plug so as to obtain the same effect. In such case, there is no need of using the oil impregnate metal to the contact portion at the jack.

Furthermore, various modified embodiments of contact segments or the like are adoptable other than the aforesaid embodiment. For example, it is of course possible to mount the metal chip to the movable tongue by welding.

While a preferred embodiment of the invention has been described using specific terms, such description is for illustrative purpose only, and it is to be understood that changes and variations may be made without departing from the spirit or scope of the following claims.

What is claimed is:

1. An electrical connection jack for use with a removable plug which rotates during use without rotating the jack, the plug having a cylindrical trunk and a tip, said jack comprising:

a hollow casing having an open end, a closed end and a plug insertion bore in said closed end, a cylindrical sleeve having a central bore, said sleeve being made of an oil impregnate metal, means attached to said closed end of said casing for holding said sleeve with said central bore aligned with said plug insertion bore providing electrical connection through said sleeve to the trunk of an inserted plug, two pairs of electrical conducting elastic contact segments mounted inside said casing, each contact segment having a resilient tongue extending therefrom, one of said pairs being positioned for said tongues thereof to flexibly hold the tip of the inserted plug therebetween at first opposite sides, the other pair being positioned for said tongues thereof flexibly hold the inserted plug therebetween at second opposite sides perpendicular to said first opposite sides so that the inserted plug is symmetrically held by said two pairs of contact segments while permitting rotation of the inserted plug, and an oil impregnate metal chip mounted on each said tongue in electrical and mechanical contact with the inserted plug.

2. An electrical connection jack as claimed in claim 1, wherein each said oil impregnate metal chip is formed as a cylinder having an axis and is mounted on its respective tongue with said axis of said cylinder perpendicular to a longitudinal axis of the inserted plug.

3. An electrical connection jack as claimed in claim 2, wherein each said cylinder is stationarily attached to its respective tongue.

4. An electrical connection jack as claimed in claim 3, wherein each said tongue has a fore end portion, each fore end portion having slots cut widthwise therein defining retaining projections, and each said cylinder has an inner bore along said axis and grooves extending longitudinally on its outer periphery, said retaining projections of said fore end portion being elastically fitted into said inner bore of said cylinder and cut edges of said fore end portion opposite to said projections being fitted into said grooves of said cylinder.

5. An electrical connection jack as claimed in claim 1, wherein said tongues of said one of said pair of contact segments diverge inwardly of said casing in the direction of said open end of said casing and are positioned to electrically connect with the tip of the inserted plug and said tongues of said other of said pairs of contact segments diverge inwardly of said casing in the direction of said closed end of said casing and are positioned to electrically connect with the trunk of the inserted plug.

6. An electrical connection jack as claimed in claim 5, the tip of the plug having an annular groove, wherein said oil impregnate metal chips of said tongues of said one of said pairs of contact segment substantially engage the annular groove of the tip of the inserted plug.

* * * * *